US009795204B2

(12) United States Patent
Chung

(10) Patent No.: US 9,795,204 B2
(45) Date of Patent: Oct. 24, 2017

(54) COMPACT USING APPLICATOR AS PUSHBUTTON

(71) Applicant: CTK CO., LTD, Gyeonggi-do (KR)

(72) Inventor: In Yong Chung, Seoul (KR)

(73) Assignee: CTK CO., LTD., Seongnam-si, Gyeonggi-Do (KR)

( * ) Notice: Subject to any disclaimer, the term of this patent is extended or adjusted under 35 U.S.C. 154(b) by 0 days.

(21) Appl. No.: 14/399,435

(22) PCT Filed: Sep. 30, 2014

(86) PCT No.: PCT/KR2014/009176

§ 371 (c)(1),
(2) Date: Nov. 6, 2014

(87) PCT Pub. No.: WO2015/190651

PCT Pub. Date: Dec. 17, 2015

(65) Prior Publication Data

US 2017/0095055 A1 Apr. 6, 2017

(30) Foreign Application Priority Data

Jun. 9, 2014 (KR) ..... 10-2014-0069134

(51) Int. Cl.
*A45D 33/02* (2006.01)
*A45D 40/00* (2006.01)
(Continued)

(52) U.S. Cl.
CPC ..... *A45D 40/0075* (2013.01); *A45D 33/34* (2013.01); *A45D 40/22* (2013.01); *A45D 42/02* (2013.01); *A45D 2200/056* (2013.01)

(58) Field of Classification Search
CPC .... A45D 33/00; A45D 33/003; A45D 33/005; A45D 33/006; A45D 33/02;
(Continued)

(56) References Cited

U.S. PATENT DOCUMENTS

2009/0133711 A1* 5/2009 Pires ..... A45D 33/00 132/293
2009/0179048 A1 7/2009 Decottignies
(Continued)

FOREIGN PATENT DOCUMENTS

KR 20-2010-0010255 U 10/2010
KR 10-2013-0107388 A 10/2013
KR 20-0470757 Y1 1/2014

*Primary Examiner* — Rachel Steitz
(74) *Attorney, Agent, or Firm* — John K. Park; Park Law Firm

(57) ABSTRACT

Provided is a compact using an applicator as a pushbutton, the compact being used in such a manner that the applicator is pushed to enable a pumping operation so that a gel phase content can be discharged to an upper part of a push plate. To do so, a metal piece (70) and a magnetic piece (80) are installed to be opposed at circumferentially equiangular positions of the applicator (60) and an intermediate body (200) arranged at an upper part of a container body (100) so that the applicator can be automatically aligned to a fixed rotation position by a magnetic force; the applicator is aligned in an exact center of the push plate by the balance of power resulting from the magnetic force and forms a spaced gap (T1) with the upper part of the push plate; and pushing operation is comfortably performed by the magnetic force.

8 Claims, 6 Drawing Sheets

(51) Int. Cl.
*A45D 40/22* (2006.01)
*A45D 42/02* (2006.01)
*A45D 33/34* (2006.01)

(58) Field of Classification Search
CPC ..... A45D 33/025; A45D 33/04; A45D 33/06; A45D 33/16; A45D 33/34; A45D 40/22; A45D 40/0075; A45D 2200/056
See application file for complete search history.

(56) References Cited

U.S. PATENT DOCUMENTS

2011/0048443 A1* 3/2011 Pires ..... A45D 33/003
132/200
2016/0073761 A1* 3/2016 Lee ..... A45D 33/025
132/298

* cited by examiner

[Fig. 1]
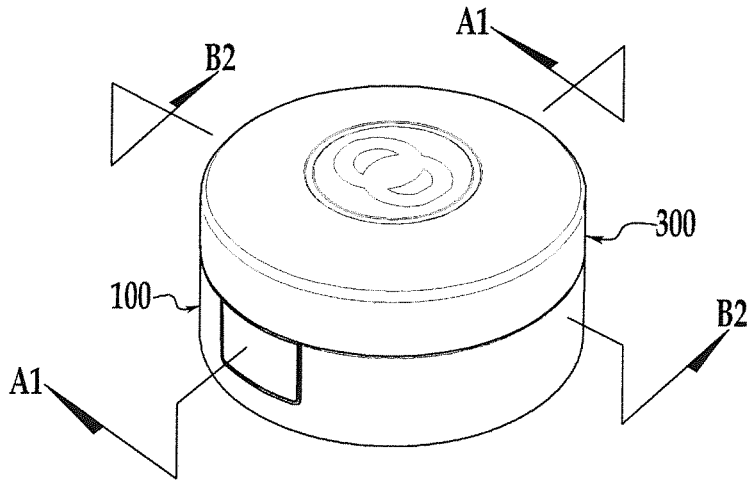
[Fig. 2]
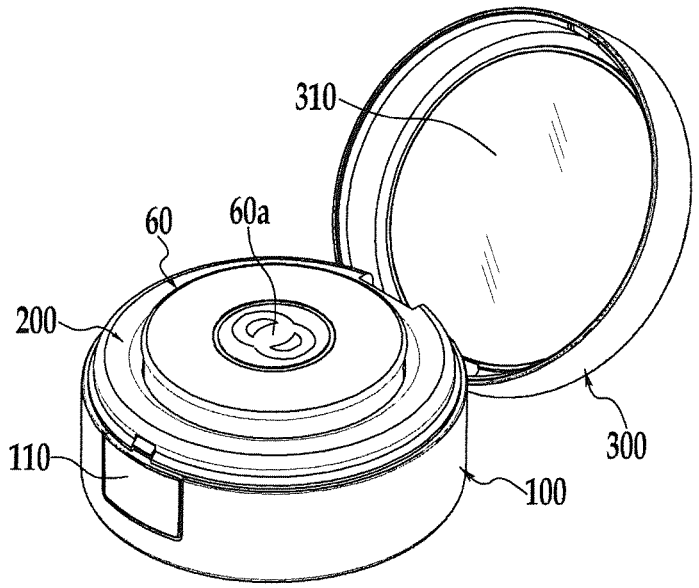
[Fig. 3]
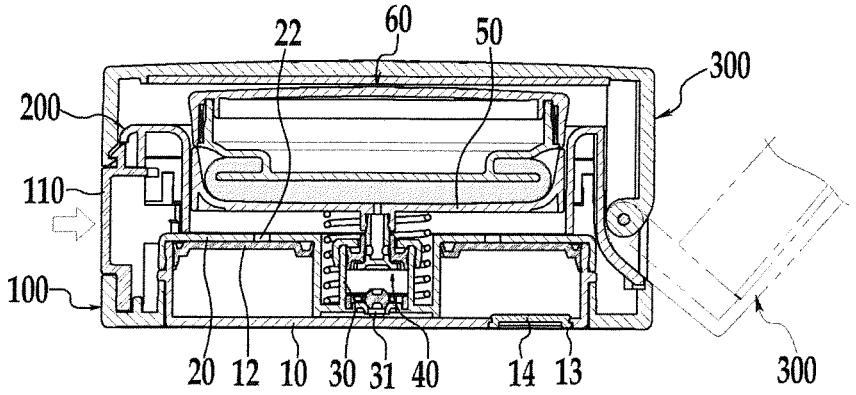

[Fig. 4]
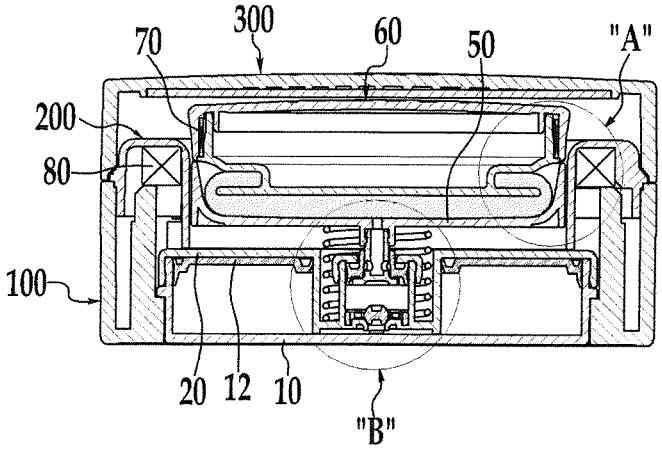
[Fig. 5]
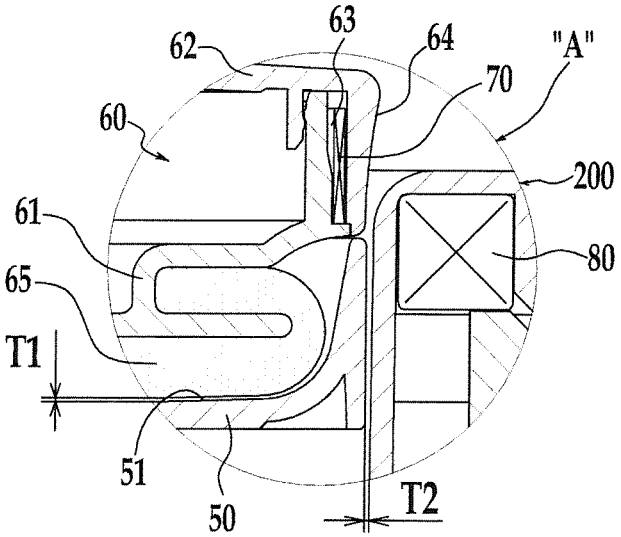

[Fig. 6]
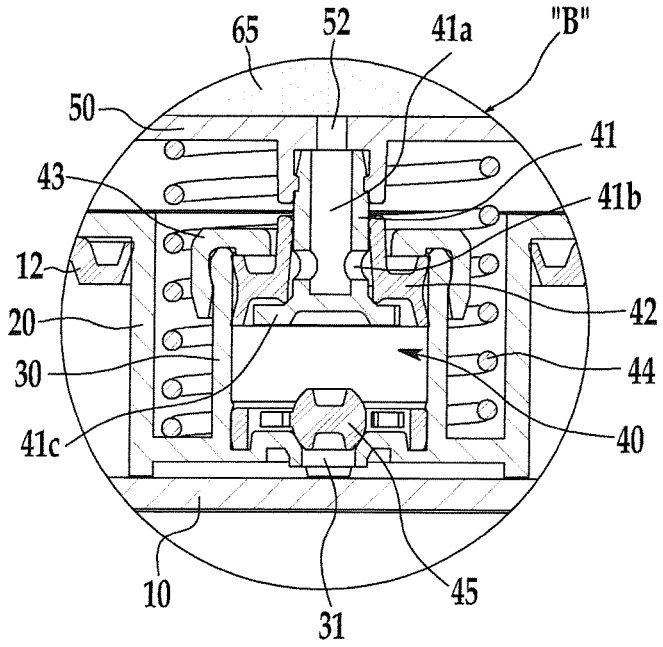
[Fig. 7]
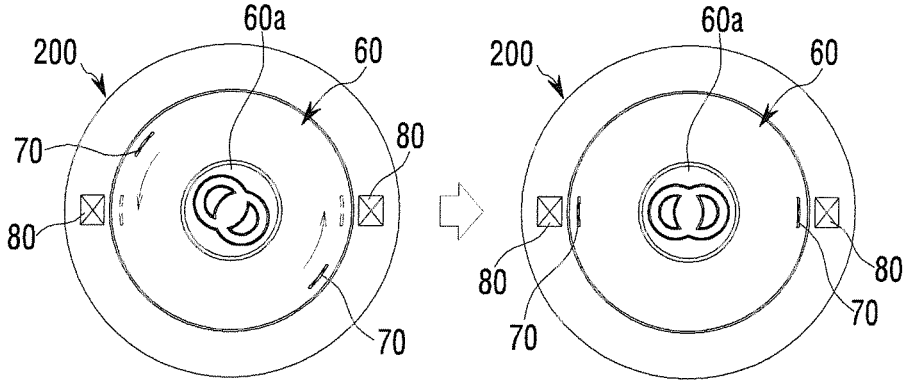
[Fig. 8]
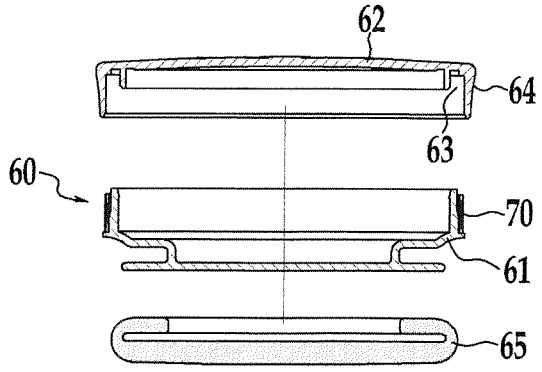

[Fig. 9]
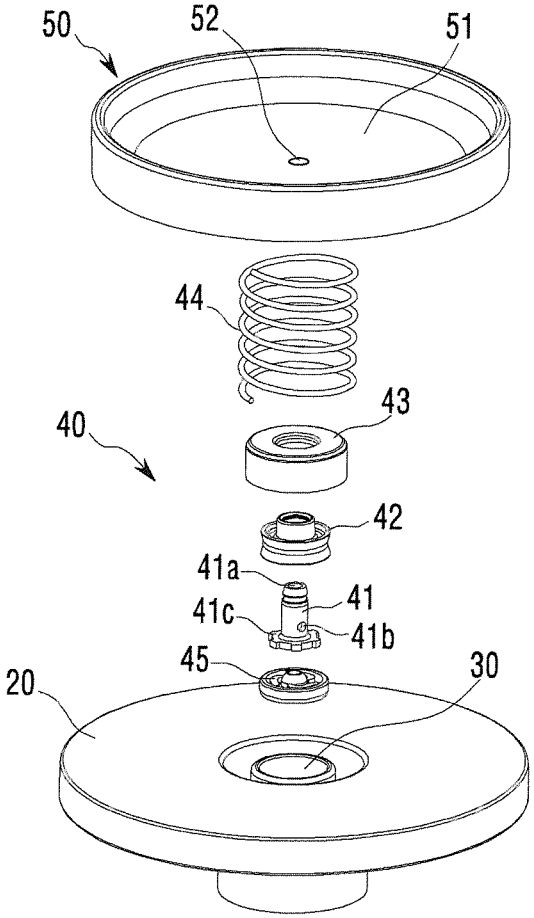

[Fig. 10]
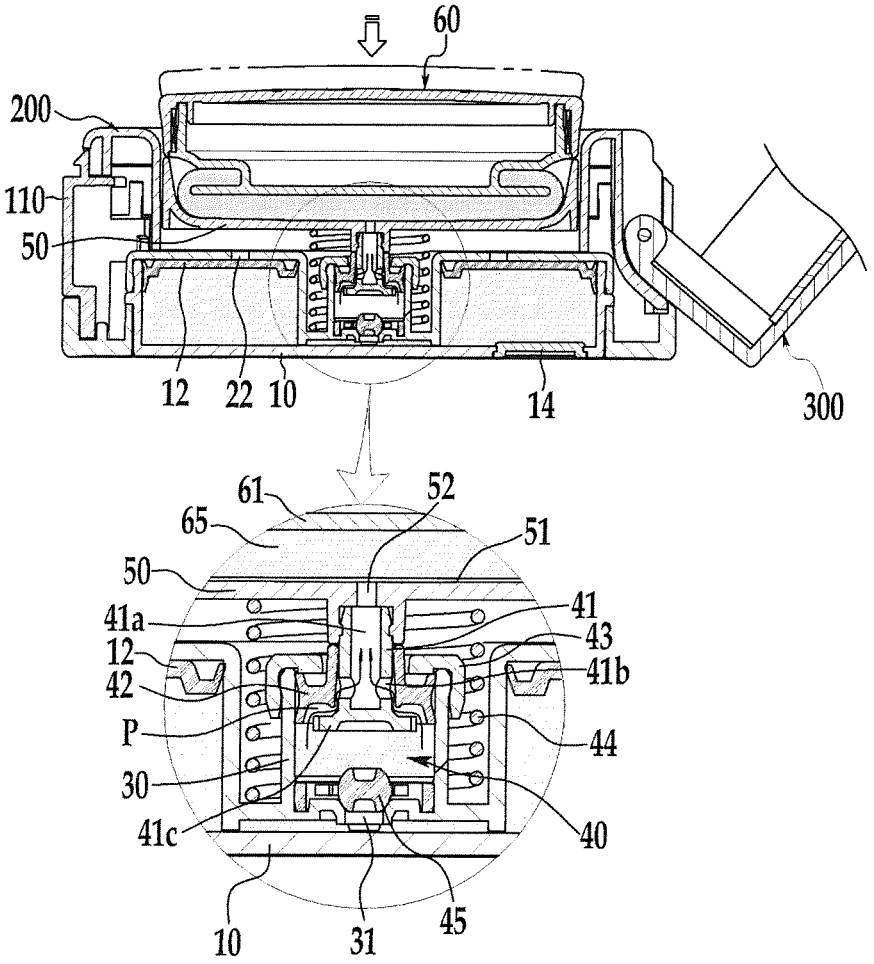

[Fig. 11]
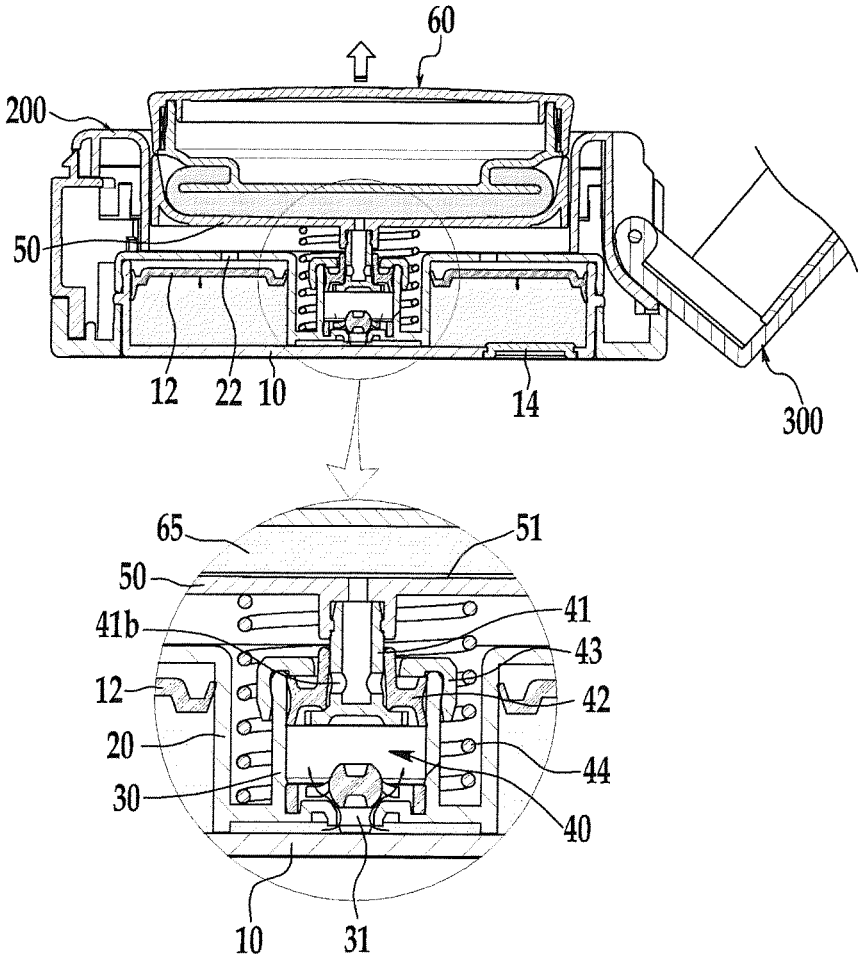

COMPACT USING APPLICATOR AS PUSHBUTTON

TECHNICAL FIELD

The present invention relates, in general, to a compact using an applicator as a pushbutton, the compact being configured such that the applicator is stably installed at an upper part of a push plate inside a container body so that a gel phase content can be discharged to the upper part of the push plate by pushing the applicator to enable a pumping operation and, more particularly, to a compact using an applicator as a pushbutton, which is configured such that a metal piece and a magnetic piece are installed to be opposed at circumferentially equiangular positions of the applicator and an intermediate body arranged at an upper part of a container body so that the applicator can be automatically aligned to a fixed rotation position of an upper part of a push plate by the effect of a magnetic force, thereby enabling the applicator to be cleanly and stably maintained; the applicator is aligned in an exact center of the push plate by the balance of power resulting from the effect of the magnetic force and forms a spaced gap with the upper part of the push plate so that the content can be prevented from bacterial contamination and corruption due to air flow; and during a pushing operation, pushing is comfortably performed by the effect of the magnetic force so that a soft touch feel can be provided, thereby providing excellent satisfaction and enabling the content to be completely discharged by a descending action of a piston provided in an inner container.

BACKGROUND ART

Generally, in a conventional compact container, powder phase contents were mainly used. These powder phase contents are disadvantageous in that the contents are scattered during their use and make-up effects are reduced because the contents have small adhesive power upon application to a user s face.

In order to overcome this disadvantage, various compact containers having an airless pump structure intended to use gel phase contents and to effectively discharge the gel phase contents have been developed.

The conventional compact container having the airless pump structure includes: a container body; and a container cap hinge-connected to the container body to open and close vertically, wherein the container body includes internally an inner container in which a gel phase content is stored, an inner container cap connected to an upper part of the inner container, a pumping operation portion formed in a central cylinder of the inner container cap, a push plate installed at an upper part of the pumping operation portion, and a puff member installed in a mounting groove of an upper part of the push plate, so that the gel phase content can be discharged to and supplied from a discharge hole in the center of the push plate by pushing the puff member so as to enable a pumping operation of the pumping operation portion, thereby enabling a user to use the gel phase content by applying the gel phase content to the puff member.

However, the conventional compact container having the airless pump structure has the following problems.

First, since the puff member is simply installed in the mounting groove of the upper part of the push plate, and the push plate is closely attached to the coating surface of a lower part of the puff member, it is difficult to circulate air, and accordingly, it is problematic in that bacterial infection occurs or content on the coating surface becomes corrupted.

Furthermore, when the compact is used, it is problematic in that various skin diseases are generated.

Second, it is problematic in that an installation position of the puff member is not regular because the puff member is simply placed in the mounting groove of the upper part of the push plate after its use, and in particular, in a case where a company logo or a company name has been printed on an upper surface of the puff member, the appearance of the puff member is not good upon opening of the container cap because the company logo or the company name is not correctly aligned, and the puff member is not cleanly and stably maintained.

Third, when the pumping operation is performed by pressing the puff member, the puff member is returned to its original state by a spring of the pumping operation portion, and at this time, the spring does not provide a regular repulsive force to the entire puff member, and accordingly, it is problematic in that the touch feel is not excellent because the puff member moves horizontally, and thus a commercial value is decreased.

Also, it is problematic in that grip comfort is decreased because an outer circumference of the puff member is formed in a simple cylindrical shape, and thus the puff member may be unintentionally separated from a user s hand when the user holds the puff member, and in that a commercial value is reduced because a gap generated between the puff member and the container body is exposed in a plan view.

Also, in the conventional compact container, in order to fill the compact container with the gel phase content, the puff member, the push plate and the inner container cap as well as the container cap must be opened. Thus, it is problematic in that workability for filling compact containers supplied from manufacturers for compact containers with gel phase contents is significantly reduced. Due to these reasons, the conventional compact containers have been supplied in a state of half-finished products or in a state of being individually packaged according to respective parts, thereby necessarily causing an increase in packaging volume and an increase in transporting costs.

CONVENTIONAL ART DOCUMENT

[Patent Document 1] Korean Patent Laid-Open Publication No. 10-2013-0040679

DISCLOSURE OF INVENTION

Technical Problem

Accordingly, the present invention has been made keeping in mind the above problems occurring in the prior art, and an object of the present invention is to provide a compact using an applicator as a pushbutton, the compact being configured such that the applicator is stably installed at an upper part of a push plate inside a container body so that a gel phase content can be discharged to the upper part of the push plate by pushing the applicator to enable a pumping operation; a metal piece and a magnetic piece are installed to be opposed at circumferentially equiangular positions of the applicator and an intermediate body arranged at an upper part of a container body so that the applicator can be automatically aligned to a predetermined rotation position of an upper part of the push plate by the effect of a magnetic force, thereby enabling the applicator to be cleanly and stably maintained; the applicator is aligned in an exact center of the push plate by the balance of power resulting from the effect of the magnetic force and forms a spaced gap with the upper part of the push plate so that the content can be prevented from bacterial contamination and corruption due to air flow; and during the pushing operation, pumping is comfortably performed by the effect of the magnetic force so that a soft touch feel can be provided, thereby providing excellent satisfaction and enabling the content to be completely discharged by a descending action of a piston provided in an inner container.

Also, another object of the present invention is to provide a compact using an applicator as a pushbutton, which is configured such that a container body is formed so that a gel phase content can be filled from the back by one touch operation from a lower part of a container body, whereby the compact container delivered in a state of being assembled as a complete product can be simply filled with the gel content; and a puff as a puff member, a metal piece and the like are formed in an assembly structure so that excellent manufacturing productivity according to exchange, disassembly and assembly can be provide.

Solution to Problem

The present invention provides a compact using an applicator as a pushbutton, the compact including: a container body; an intermediate body connected to an upper part of the container body; and a container cap hinge-connected to the container body to close and open, wherein the container body includes internally an inner container configured for storing a gel phase content, an inner container cap connected to an upper part of the inner container, a piston disposed inside the inner container so as to push the gel phase content while vertically moving downwards whenever a discharging operation of the gel phase content is performed, and a pumping operation portion formed in the center of the inner container cap so as to be connected inside a cylinder having an inlet; the intermediate body includes internally a push plate positioned at an upper part of the pumping operation portion, and an applicator installed in a mounting groove of an upper part of the push plate so that the gel phase content can be discharged and supplied via a discharge hole in the center of the push plate by pushing the applicator so as to enable a pumping operation of the pumping operation portion; and in the applicator and the intermediate body positioned at an outer side of the applicator, a metal piece and a magnetic piece are installed to be opposed at circumferentially equiangular positions so that the applicator in the mounting groove of the upper part of the push plate can be automatically aligned to a fixed rotation position by the effect of a magnetic force of the metal piece and the magnetic piece.

Also, the present invention provides a compact using an applicator as a pushbutton, the compact including: a container body; an intermediate body connected to an upper part of the container body; a container cap hinge-connected to the container body to close and open vertically, wherein the container body includes internally an inner container configured for storing a gel phase content, an inner container cap connected to an upper part of the inner container, a piston disposed inside the inner container so as to push the gel phase content while vertically moving downwards whenever discharging operation of the gel phase content is performed, and a pumping operation portion formed in the center of the inner container cap to be connected inside a cylinder having an inlet; the intermediate body includes internally a push plate positioned at an upper part of the pumping operation portion, and an applicator installed in a mounting groove of an upper part of the push plate so that the gel phase content can be discharged and supplied via a discharge hole in the center of the push plate by pushing the applicator so as to enable pumping operation of the pumping operation portion; and in the applicator and the intermediate body positioned at an outer side of the applicator, a metal piece and a magnetic piece are installed to be opposed at circumferentially equiangular positions so that the balance of power can be maintained such that the applicator is positioned in the exact center of the mounting groove arranged at the upper part of the push plate by the operation of a magnetic force of the metal piece and the magnetic piece, and the applicator in the mounting groove is separated upwards from the upper part of the push plate so as to form a spaced gap for enabling air flow.

According to the present invention, it is preferable that the metal piece and the magnetic piece be configured to be positioned on the same horizontal line.

According to the present invention, the applicator may include: a puff body in which a puff is detachably connected to a lower part thereof; and a body cap insertably connected to an upper part of the puff body, so that the metal piece may be configured to be inserted into an assembly groove formed at two circumferentially equiangular positions between the puff body and the body cap, wherein the body cap has an inclined curve portion formed to be inclined so that an upper part of an outer circumference can have a larger diameter than that of a lower part, and as a result, grip comfort can be improved and a gap generated between the intermediate body and the puff member can be covered in a plan view.

According to the present invention, a back-filling hole may be further formed at a bottom of the inner container, and a sealing cap (14) may be openably connected to the back-filling hole so that the gel content can be filled from the back after assembly of the compact container.

Advantageous Effects of Invention

According to the present invention, the applicator is stably installed at an upper part of a push plate inside a container body so that a gel phase content can be discharged to the upper part of the push plate by pushing the applicator to enable a pumping operation; a metal piece and a magnetic piece are installed to be opposed at circumferentially equiangular positions of the applicator and an intermediate body arranged at an upper part of a container body so that the applicator can be automatically aligned to a predetermined rotation position of an upper part of a push plate by the effect of a magnetic force, thereby enabling the applicator to be cleanly and stably maintained; the applicator is aligned in an exact center of the push plate by the balance of power resulting from the effect of the magnetic force and forms a spaced gap with the upper part of the push plate so that the content can be prevented from bacterial contamination and corruption due to air flow; during the pushing operation, pumping is comfortably performed by the effect of the magnetic force so that a soft touch feel can be provided, thereby providing excellent satisfaction; and while descending vertically, a piston provided in an inner container pushes the gel phase content downwards whenever the gel phase content is discharged, so that the discharging operation of the gel phase content can be smoothly performed and the gel phase content can be completely discharged.

Also, the container body is formed so that the gel phase content can be filled from the back from a lower part of the container body by a one-touch operation, whereby the compact container delivered in a state of being assembled as a complete product can be simply filled with the gel phase content, and the puff of the applicator, the metal piece and the like are formed in an assembly structure so that excellent manufacturing productivity according to exchange, disassembly, and assembly can be provided.

BRIEF DESCRIPTION OF DRAWINGS

FIG. 1 is a perspective view showing the assembly of a compact according to the present invention;

FIG. 2 is a perspective view showing a partially open state of the compact according to the present invention;

FIG. 3 is a cross-sectional view taken along line A1-A1 of FIG. 1;

FIG. 4 is a cross-sectional view taken along line B2-B2 of FIG. 1;

FIG. 5 is a partially enlarged view of portion A of FIG. 4;

FIG. 6 is a partially enlarged view of portion B of FIG. 4;

FIG. 7 is a plan view of main parts showing an automatic alignment structure of an applicator according to the present invention;

FIG. 8 is an exploded cross-sectional view of the applicator according to the present invention;

FIG. 9 is an extracted and exploded perspective view of a pumping operation portion according to the present invention;

FIG. 10 is a cross-sectional view showing a pushed state of the applicator according to the present invention; and FIG. 11 is a cross-sectional view showing a push-released state of the applicator according to the present invention.

MODE FOR THE INVENTION

Hereinafter, preferred embodiments according to the present invention will be described in detail with reference to the accompanying drawings.

A compact using an applicator as a pushbutton according to the present invention is largely composed of, as illustrated in FIGS. 1 to 9, a container body 100, an intermediate body 200 connected to an upper part of the container body; and a container cap 300 hinge-connected to the container body so as to close and open.

The container body 100 includes, internally: an inner container 10 in which a gel phase content is stored; an inner container cap 20 connected to an upper part of the inner container; a cylinder 30 installed in the center of the inner container cap 20; and a pumping operation portion 40 connected to the inside of the cylinder. Inside the inner container, a ring-shaped piston 12 configured for pushing the gel phase content downwards upon discharging operation of the gel phase content is installed, and the inner container cap 20 has at least one air hole 22 formed for facilitating smooth vertically downward movement of the piston 12.

The intermediate body 200 includes, internally, a push plate 50 installed to be positioned at an upper part of the pumping operation portion 40 and an applicator 60 installed in a mounting groove 51 of an upper part of the push plate so that the gel phase content can be discharged and supplied via a discharging hole 52 in the center of the push plate by pushing the applicator 60 to enable pumping operation of the pumping operation portion 40.

In particular, in the applicator 60 and the intermediate body 200 arranged at an outer side of the applicator, a metal piece 70 and a magnetic piece 80 are installed to be opposed at two circumferentially equiangular positions so that the applicator 60 in the mounting groove 51 of an upper part of the push plate 50 can be automatically aligned to a fixed rotation position by the effect of a magnet force of the metal piece 70 and the magnetic piece 80.

That is, the applicator 60 is configured to be automatically aligned to a predetermined rotation position in the mounting groove 51 of the upper part of the push plate 50 so that a printing part 60*a* printed with a company logo or a company name on an upper surface of the applicator can be regularly positioned (see FIG. 7).

Also, in the applicator 60 and the intermediate body 200 located at the outer side of the applicator, the metal piece 70 and the magnetic pieces 80 are installed to be opposed at two circumferentially equiangular positions or at least two circumferentially equiangular positions so that the balance of power can be maintained such that the applicator 60 is positioned in the exact center of the mounting groove 51 arranged at the upper part of the push plate 50 by the effect of a magnetic force of the metal piece and the magnetic piece, and the applicator in the mounting groove 51 of the upper part of the push plate 50 is separated upwards from the upper part of the push plate so as to form a spaced gap T1 for enabling air flow (see FIG. 5).

At this time, the metal piece 70 and the magnetic piece 80 may be configured to be positioned on the same horizontal line, or the metal piece 70 and the magnetic piece 80 may be configured to be dislocated vertically.

Also, the applicator 60 includes: a puff body 61 in which a puff 65 is detachably connected to a lower part of the puff body; and a body cap 62 insertably connected into an upper part of the puff body 61, wherein the metal piece 70 is installed to be inserted into an assembly groove 63 formed at two circumferentially equiangular positions between the puff body 61 and the body cap 62.

Furthermore, the body cap 62 of the applicator 60 has an inclined curve portion 64 formed to be inclined so that an upper part of an outer circumference can have a larger diameter than that of a lower part thereof, so that it is preferable to configure the body cap to cover a gap T2 generated between the intermediate body 200 and the applicator 60 in a plan view while enabling improvement in grip comfort (see FIG. 5).

Also, the pumping operation portion 40 includes: a stem 41 installed inside the cylinder 30; a stem piston 42 installed between an outer circumferential surface of the stem and an inner circumferential surface of the cylinder 30; a sealing cap 43 connected to an upper part of the cylinder; a spring-shaped lifting member 44 installed between an outer side of the cylinder and a lower part of the push plate 50; and a check valve 45 configured for blocking an inlet 31 formed at a lower part of the cylinder.

At this time, a hollow hole 41*a* connected to the discharging hole 52 of the push plate 50 is formed in an inner center of the stem 41, an inflow hole 41*b* for inflow of the gel phase content is formed in a lower side of the hollow hole, and a support flange 41*c* is integrally formed on a lower circumference.

Furthermore, a back-filling hole 13 is formed at a bottom of the inner container 10, a sealing cap 14 is openably connected to the back-filling hole 13 so that the gel phase content can be filled after assembly of the compact.

With regard to non-described reference numerals, reference numeral 110 refers to an open button provided in the container body 100 to be pushable, and reference numeral 310 refers to a mirror provided inside an upper cap.

The operation and action of the compact configured as described above using the applicator as the pushbutton according to present invention will be reviewed.

The compact according the present invention is operated in such a manner as to open the container cap 300 installed at the upper part of the container body 100 by operating the open button 110, and thereafter, to apply the gel phase content to the user s skin using the applicator 60 mounted in the mounting groove 51.

In particular, since of the metal piece 70 and the magnetic piece 80 are installed to be opposed at two circumferentially equiangular positions of the applicator 60 and the intermediate body 200 connected to the upper part of the container body 100, when the applicator 60 is maintained in a state of being mounted in the mounting groove 51 of the upper part of the push plate 50, as illustrated in FIG. 7, the applicator 60 rotates automatically so that the metal piece 70 and the magnetic piece 80 can be positioned to correspond to each other by the effect of a magnetic force of the metal piece 70 and the magnetic force 80, and thus the applicator 60 in the mounting groove 51 of the push plate 50 is automatically aligned to a fixed rotation position.

Thus, since the printing portion 60*a* printed with a company logo or name on the upper surface of the applicator 60 is aligned at a fixed position, when the container cap 300 of the upper part of the container body is open, the applicator 60 is always aligned at an exact position, so that a neat appearance can be provided to consumers and storage stability can be maintained.

Moreover, the applicator 60 is positioned in an exact center of the mounting groove 51 arranged at the upper part of the push plate 50 because the balance of power is maintained by the effect of the magnetic force of the metal piece 70 and the magnetic piece 80, and the applicator in the mounting groove 51 of the upper part of the push plate 50 is separated upwards from the upper part of the push plate to form a spaced gap T1 with the push plate 50 so that air flow can be always smoothly performed, and as a result, the content on the puff 65 of the applicator 60 can be prevented from bacterial contamination or corruption as is typical in existing products.

Also, since the body cap 62 of the applicator 60 has the inclined curve portion 64 formed to be inclined so that that the upper part of the outer circumference can have a larger diameter than that of a lower part, grip comfort upon holding of the applicator may be improved, and the applicator may be prevented from being unintentionally separated from the user s hand. Furthermore, in a plan view, since the gap T2 generated between the intermediate body 200 and the applicator 60 is covered, neat and stable storage can be maintained.

As described above, the compact according to the present invention is used in such a manner that the applicator 60 mounted in the mounting groove 51 of the upper part of the push plate 50 inside the container body 100 is pushed to enable a pumping operation of the pumping operation portion 40 so that the content can be discharged.

More specifically, as shown in FIG. 10, the applicator 60 is pushed while compressing the lifting member 44 of the pumping operation portion 40.

At this time, since the applicator 60 is pushed in a state of being separated upwards from the upper part of the push plate in the exact center of the mounting groove 51 arranged at the upper part of the push plate 50 rather than being simply pushed while compressing the lifting member 44, the applicator 60 is comfortably pushed by the effect of the magnetic force acting on the applicator, and thus a repulsive force acts on the entire body of the applicator 60 so that the applicator can be regularly pushed and a soft touch feel thereof can be also provided.

As such, when the applicator 60 is pushed, the stem 41 is primarily descended by the push plate 50, a minute discharge space P is provided between the flange 41*c* and the stem piston 42 provided on an outer circumferential surface of the stem, and at the same time, the gel phase content entered into the cylinder 30 flows into the inlet hole 41*b* of the stem 41 via the discharge space; and a suitable amount of gel phase content is finally discharged via the discharge hole 52 of the push plate 50 by passing a cavity portion 41*a* of the stem formed to communicate with the discharge hole and is then diffused on the upper surface of the push plate 50 via the spaced gap T1 between the push plate 50 and the applicator 50 so as to be used in a state of being uniformly applied on the puff 65 of the applicator.

Furthermore, when the applicator 60 is continuously pushed, the stem 41 is descended, and thus the stem piston 42 is also downwardly moved. Due to this, the discharge space provided between the stem piston and the flange 41*c* of the stem is descended again in a state of being closed, and at this time, due to a descending compression effect of the stem and the stem piston, the inlet 31 of the cylinder 30 is more firmly blocked by the check valve 45 so that the gel phase content entered in the cylinder 30 can be prevented from flowing backward into the inner container 10.

Meanwhile, when a force applied to the applicator 60 is released, the push plate 50 is returned to its original state by a reaction force as illustrated in FIG. 11, and the stem 41 connected thereto is also upwardly moved. At the same time, the stem piston is also upwardly moved. Furthermore, in the inside of the cylinder 30, as the check valve 45 is forcibly lifted by attraction power generated at the time of lifting operation of the stem 41, the inlet 31 of the cylinder 30 is open, and at the same time, a suitable amount of gel phase content contained in the inner container 10 smoothly flows via the inlet. Furthermore, during a flowing process of the gel phase content, the piston 12 disposed in the inner container 10 compresses the gel phase content to be compressed downwards while vertically closely descending along an internal wall of the inner container 10 and an internal wall provided at an outer side of the cylinder of the inner container cap 29.

Accordingly, thanks to the descending compression action of the piston 12, the gel phase content contained in the inner container 10 more smoothly enters into the cylinder via the inlet formed in the cylinder 30 upon, in particular, lifting operation of the push plate 50, and the descending compression action also enables the gel phase content contained in the inner container 10 to be completely used with no content remaining.

The descending compression action of the piston 12 is performed by being linked with the pumping operation portion 40 whenever touching the push plate 50 using the applicator 60 and enables the gel phase content contained in the inner container 10 to be pushed downwards.

Furthermore, after the applicator 60 has been separated from the push plate 50 for use, when the applicator is again maintained in a state of being installed at the upper part of the push plate after use, the applicator 60 is automatically aligned to a fixed rotation position in the mounting groove 51 of the upper part of the push plate 50 as previously described even though the applicator 60 is carelessly dispensed on the push plate. For example, as shown in FIG. 7, thanks to the magnetic force of the metal piece 70 and the magnetic piece 80, the applicator is automatically aligned so that the printed portion 60*a* can be always disposed at an exact position.

Also, the puff 65 of the applicator 60 in the mounting groove 51 of the push plate 50 is installed to be separated upwards from the push plate to have the spaced gap T1 for enabling air flow.

Furthermore, in the present invention, since the puff 65 of the applicator 60 is detachably connected to a lower assembly portion of the puff body 61 in an insertion method, the puff can be simply exchanged and used.

Furthermore, because the metal piece 70 inside the applicator 60 is configured in such an assembly method that the metal piece is inserted into the assembly groove 63 formed at two circumferentially equiangular positions between the puff body 61 and the body cap 62 inserted into an upper part of the puff body 61, work for assembly, disassembly and the like can be simplified.

Also, in the present invention, since the gel phase content filled in the inner container 10 is formed so as to be filled from the back via the back-filling hole 13, when the compact has been produced and delivered to respective cosmetic manufacturers, the respective cosmetic manufacturers can simply fill the compact with the gel phase content. Furthermore, since the gel phase content can be distributed in a sealing state using the sealing cap 14, in terms of manufacturing production, excellent convenience can be provided. Also, unlike an existing case where respective parts are individually packed and supplied, it is advantageous in that the compact may be packed and supplied in a state of being assembled into a complete product thanks to the presence of a back-filling function so that packaging volume and costs can be remarkably reduced.

Although the present invention has been described with reference to the embodiments and accompanying drawings, the present invention should not be limited thereto but should be interpreted that various modifications and changes are possible, without departing from the scope and spirit of the invention as disclosed in the accompanying claims.

The invention claimed is:

1. A compact using an applicator as a pushbutton, comprising:

a container body (100); an intermediate body (200) connected to an upper part of the container body; and a container cap (300) hinge-connected to the container body to close and open, wherein the container body (100) includes, internally: an inner container (10) configured for storing a gel phase content; an inner container cap (20) connected to an upper part of the inner container; a piston (12) disposed inside the inner container to push the gel phase content while vertically moving downwards whenever discharging the gel phase content; and a pumping operation portion (40) formed in the center of the inner container cap (20) to be connected inside a cylinder (30) having an inlet (31), the intermediate body (200) includes, internally: a push plate (50) positioned at an upper part of the pumping operation portion (40); and an applicator (60) installed in a mounting groove (51) of an upper part of the push plate, so that the gel phase content is discharged and supplied via a discharge hole (52) in the center of the push plate, or is blocked by pushing the applicator (60) so as to enable a pumping operation of the pumping operation portion (40), and in the applicator (60) and the intermediate body (200) positioned at an outer side of the applicator, a metal piece (70) and a magnetic piece (80) are installed to be opposed at circumferentially equiangular positions so that the applicator (60) in the mounting groove (51) of the upper part of the push plate (50) rotates automatically and circumferentially to be aligned to a fixed rotation position by the effect of a magnetic force of the metal piece and the magnetic piece.

2. The compact of claim 1, wherein the metal piece (70) and the magnetic piece (80) are configured to be positioned on the same vertical line.

3. The compact of claim 1, wherein the applicator (60) comprises a puff body (61) in which a puff (65) is detachably connected to a lower part thereof; and a body cap (62) insertably connected to an upper part of the puff body, so that the metal piece (70) is inserted into an assembly groove (63) formed at two circumferentially equiangular positions between the puff body (61) and the body cap (62), and the body cap (62) has an inclined curve portion (64) formed to be inclined so that an upper part of an outer circumference has a larger diameter than that of a lower part, and thus the body cap is configured to cover a gap (T2) generated between the intermediate body (200) and the applicator (60) in a plan view while enabling improvement in grip comfort.

4. The compact of claim 1, wherein a back-filling hole (13) is further formed at a bottom of the inner container (10), and a sealing cap (14) is openably connected to the back-filling hole (13) so that the gel content is filled from the back after assembly of the compact container.

5. A compact using an applicator as a pushbutton, comprising:

a container body (100); an intermediate body (200) connected to an upper part of the container body; a container cap (300) hinge-connected to the container body to close and open vertically;

wherein the container body (100) includes, internally: an inner container (10) configured for storing a gel phase content; an inner container cap (20) connected to an upper part of the inner container; a piston (12) disposed inside the inner container to push the gel phase content while vertically moving downwards whenever discharging the gel phase content; and a pumping operation portion (40) formed in the center of the inner container cap (20) to be connected inside a cylinder (30) having an inlet (31), the intermediate body (200) includes, internally: a push plate (50) positioned at an upper part of the pumping operation portion (40); and an applicator (60) installed in a mounting groove (51) of an upper part of the push plate, so that the gel phase content is discharged and supplied via a discharge hole (52) in the center of the push plate, or is blocked by pushing the applicator (60) so as to enable a pumping operation of the pumping operation portion (40), and in the applicator (60) and the intermediate body (200) positioned at an outer side of the applicator, a metal piece (70) and a magnetic piece (80) are installed to be opposed at circumferentially equiangular positions, so that the applicator (60) in the mounting groove (51) of the upper part of the push plate (50) rotates automatically and circumferentially to be aligned to a fixed rotation position by the effect of a magnetic force of the metal piece and the magnetic piece, and so that the balance of power is maintained such that the applicator (60) is positioned in an exact center of the mounting groove (51) arranged at the upper part of the push plate (50) by the effect of a magnetic force of the metal piece and the magnetic piece, and the applicator in the mounting groove (51) of the upper part of the push plate (50) is separated upwards from the upper part of the push plate so as to form a spaced gap (T1) for enabling air flow.

6. The compact of claim 5, wherein the metal piece (70) and the magnetic piece (80) are configured to be positioned on the same vertical line.

7. The compact of claim 5, wherein the applicator (60) comprises a puff body (61) in which a puff (65) is detachably connected to a lower part thereof; and a body cap (62) insertably connected to an upper part of the puff body, so that the metal piece (70) is inserted into an assembly groove (63) formed at two circumferentially equiangular positions between the puff body (61) and the body cap (62), and the body cap (62) has an inclined curve portion (64) formed to be inclined so that an upper part of an outer circumference has a larger diameter than that of a lower part, and thus the body cap is configured to cover a gap (T2) generated between the intermediate body (200) and the applicator (60) in a plan view while enabling improvement in grip comfort.

8. The compact of claim 5, wherein a back-filling hole (13) is further formed at a bottom of the inner container (10), and a sealing cap (14) is openably connected to the back-filling hole (13) so that the gel content is filled from the back after assembly of the compact container.

* * * * *